US012226056B1

(12) United States Patent
Chen

(10) Patent No.: US 12,226,056 B1
(45) Date of Patent: Feb. 18, 2025

(54) BABY BATH CHAIR

(71) Applicant: Taizhou Tongchuang Maternal and Infant products Co., Ltd., Taizhou (CN)

(72) Inventor: Hui Chen, Taizhou (CN)

( * ) Notice: Subject to any disclaimer, the term of this patent is extended or adjusted under 35 U.S.C. 154(b) by 0 days.

(21) Appl. No.: 18/761,514

(22) Filed: Jul. 2, 2024

(30) Foreign Application Priority Data

Jun. 17, 2024 (CN) ..... 202421366212.7

(51) Int. Cl.
*A47K 3/12* (2006.01)

(52) U.S. Cl.
CPC ..... *A47K 3/127* (2013.01); *A47K 3/122* (2013.01)

(58) Field of Classification Search
CPC ..... A47K 3/127; A47K 3/122
USPC ..... 4/572.1
See application file for complete search history.

(56) References Cited

U.S. PATENT DOCUMENTS 5,010,606 A * 4/1991 Bernstein ..... A47K 3/127 4/572.1
5,317,765 A * 6/1994 Knoedler ..... A47K 3/127 D23/304
5,321,859 A * 6/1994 Buckshaw ..... A47K 3/127 D6/333
5,588,158 A * 12/1996 Poulson ..... A47K 3/127 4/572.1
5,687,433 A * 11/1997 Garner ..... A47K 3/127 297/487
2019/0174966 A1* 6/2019 Murphy ..... A47K 3/127

* cited by examiner

*Primary Examiner* — Huyen D Le

(57) ABSTRACT

A baby bath chair includes a base and a handrail. A rear side of the base is provided with a backrest extending upward. The handrail is connected to the backrest and is able to rotate between an enclosed position and an opened position. The handrail rotates to the enclosed position, the handrail, the backrest and the base enclose to form a seat space for restricting a lateral movement of a baby's body. By the above-mentioned structure, when the baby enters and exits the seat space of the baby bath chair, the handrail rotates to the open position which makes it convenient for the baby to enter and exit the seat space of the baby bath chair with simple operation.

18 Claims, 5 Drawing Sheets

BABY BATH CHAIR

CROSS-REFERENCE TO RELATED APPLICATIONS

The present disclosure claims priority of Chinese patent application CN2024213662127, filed on 2024 Jun. 17, which is incorporated herein by reference in its entireties.

TECHNICAL FIELD

The present disclosure relates to the technical field of baby products, and in particular to a baby bath chair.

BACKGROUND

A baby bath chair is a tool used to assist in baby's bathing.

At present, a common way to bath the baby is by an adult holding the baby with one hand, and the other hand washes the baby, or a person holds the baby, and the other person washes the baby, and the baby baths in a small bathtub or basin. Because the baby is naturally active, which has no ability to take care of himself, if the baby is bathed by only one person, it will take a lot of energy. And it is also easy to cause the baby to choke, injury or more serious consequences. As a result, people began to use baby bath chair to assist in baby's bathing.

However, there are some problems or places that can be improved for this kind of baby bath chair: a fence of the baby bath chair cannot play a complete restriction on a body of the baby, because the baby is very active, especially resists when taking a bath. It is very easy to appear the problem of falling to one side. Although some products are used to the fence, a handrail to restrict the body of the baby, but the fence and the handrail cannot realize the convenient of quick opening and closing, which causes the inconvenience in use.

The present disclosure provides a baby bath chair that is structurally simple and convenient to use.

SUMMARY

In order to overcome the shortcomings of the prior art, the present disclosure provides a baby bath chair that is structurally simple and convenient to use.

A technical solution adopted by the present disclosure to solve the technical problem is as follows.

A baby bath chair includes: a base, a rear side of the base provided with a backrest extending upward; a handrail connected to the backrest and being able to rotate between an enclosed position and an opened position; wherein the handrail rotates to the enclosed position, the handrail, the backrest and the base enclose to form a seat space for restricting a lateral movement of a baby's body.

As an improvement of the present disclosure, a front central side of the base is provided with a locking assembly, a connecting end of the handrail is hinged to the backrest, and a free end of the handrail is detachably connected to the locking assembly.

As an improvement of the present disclosure, the locking assembly includes a locking shell, a locking block and an elastic reset element, the locking block is configured to be slidingly arranged within the locking shell and is configured to move between the locking position and the release position, one end of the elastic reset element butts against the locking block, the other end of the elastic reset element is pressed against the inner wall of the locking housing, the elastic reset element is configured to drive the locking block to move towards the locking position to lock the free end of the handrail.

As an improvement of the present disclosure, the free end of the handrail is provided with a locking groove, and the locking block provided with a locking part, when the handrail rotates to the enclosed position, the elastic reset part drives the locking block to move toward the locking position, and the locking part is inserted into the locking groove.

As an improvement of the present disclosure, the free end of the handrail provided with a guide groove, the locking block is provided with a guide portion, when the handrail rotates towards the enclosed position, the guide portion is inserted into and slides along the guide groove.

As an improvement of the present disclosure, the locking assembly further includes a pressing element, the pressing element is slidely connected to the locking housing, a lower end of the pressing element extends through the locking housing to engage with the locking block, the pressing element is configured to allow a user to press and moves the locking block towards the release position for releasing the free end of the handrail.

As an improvement of the present disclosure, the locking housing includes an upper locking housing and a lower locking housing, the upper locking housing is connected to the lower locking housing, a cartridge groove is formed between the upper locking housing and the lower locking housing, when the handrail rotates to the enclosed position, the free end of the handrail is inserted into the cartridge groove.

As an improvement of the present disclosure, a front central side of the base extends upward to form a connecting post, a bottom of the locking assembly is provided with a connecting groove, and the connecting post is inserted into the connecting groove.

As an improvement of the present disclosure, the connecting end of the handrail is provided with a shaft hole, a side of the backrest is provided with a rotating shaft, and the rotating shaft is inserted into the shaft hole so that the handrail is able to rotate relative to the backrest.

As an improvement of the present disclosure, the baby bath chair further includes a shaft fixing element, a connecting hole is arranged on a surface of the rotating shaft, the shaft fixing element is inserted into the connecting hole, and an edge of the shaft fixing element is butted against the connecting end surface of the handrail.

As an improvement of the present disclosure, the baby bath chair further includes a cushion portion, a through hole is provided on a surface of the cushion portion, an opening is provided in a middle of the base, and the cushion portion is adjacent to cover the opening, and the through hole communicates with the opening.

As an improvement of the present disclosure, the baby bath chair further includes a suction cup connected to a bottom of the base, and the suction cup is configured for adsorbing on a placement surface.

As an improvement of the present disclosure, the base is provided with a suction cup hole, and the suction cup is detachably inserted into the suction cup hole.

As an improvement of the present disclosure, the suction cup is provided with an upper groove, and an inner wall of the suction cup hole is providedd with a locking part, and the ocking part is clamped into the groove.

As an improvement of the present disclosure, the backrest includes an upper backrest shell and a lower backrest shell, and the upper backrest shell is detachably connected to the lower backrest housing.

As an improvement of the present disclosure, the upper backrest housing is provided with a clamping block, the lower backrest housing is provided with a clamping groove, and the clamping block is clamped into the clamping groove.

As an improvement of the present disclosure, a surface of the backrest is provided with a grasping groove, and the grasping groove is configured for a user's fingers to insert.

As an improvement of the present disclosure, a bottom of the base is provided with a reinforcing rib.

As an improvement of the present disclosure, the suction cup is provided with a detachment bump, and the detached bump is configured for a user to grasp. The beneficial effects of the present disclosure are as follows: by the above-mentioned structure, when the baby enters and exits the seat space of the baby bath chair, the handrail can be rotated to the open position which makes it convenient for the baby to enter and exit the seat space of the baby bath chair with simple operation. When bathing the baby, the handrail can be rotated to the enclosed position. The handrail and the backrest can provide supporting at this time, restricting the baby's lateral body movement for a safer product use. It also makes it easier for the user to bath the baby, and the rotatable handrail can be easily opened and closed for convenient use.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
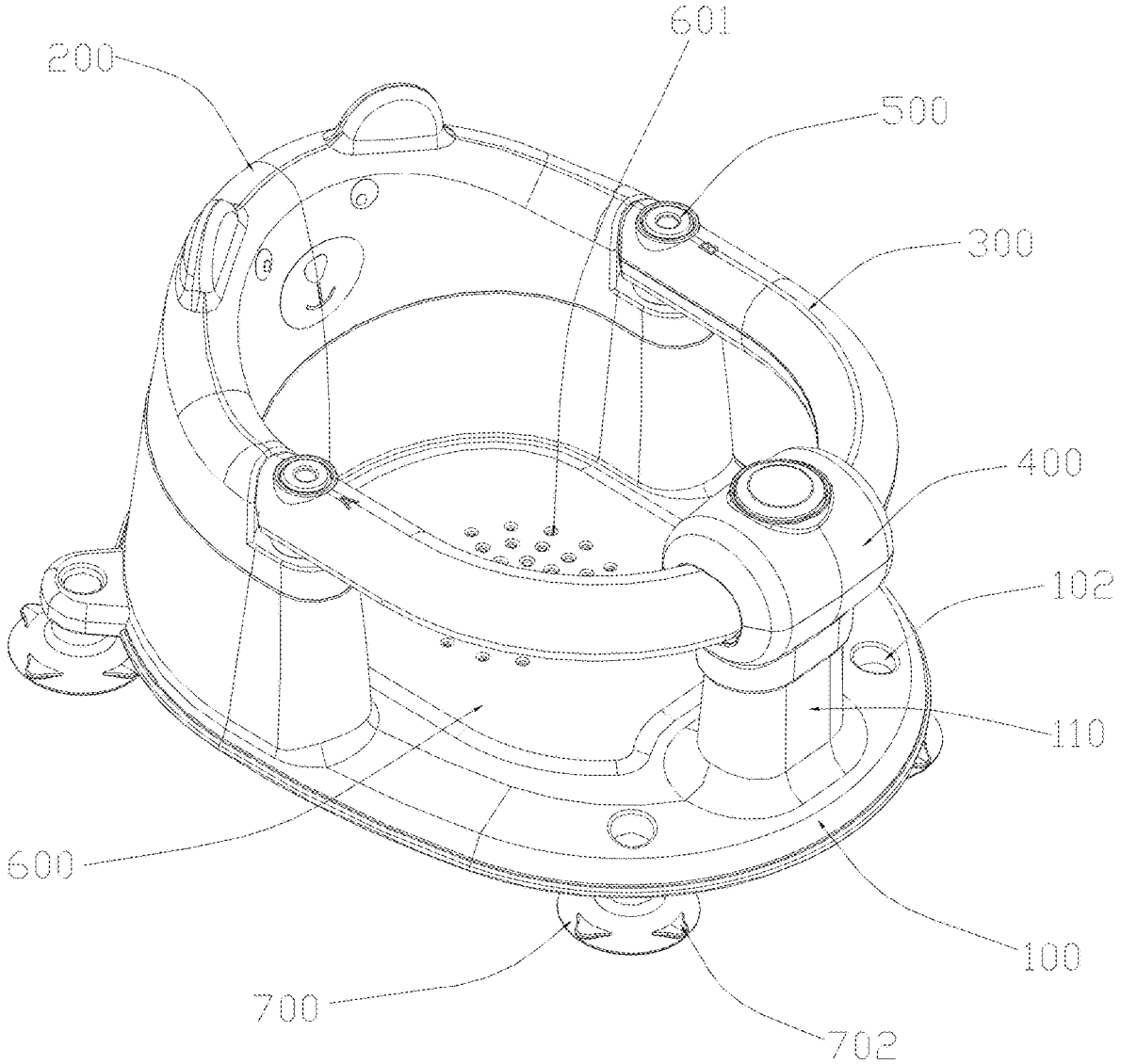
FIG. 1 is a schematic diagram of a baby bath chair showing a corner angle of an enclosed state according to an embodiment of the present disclosure.
Figure 2:
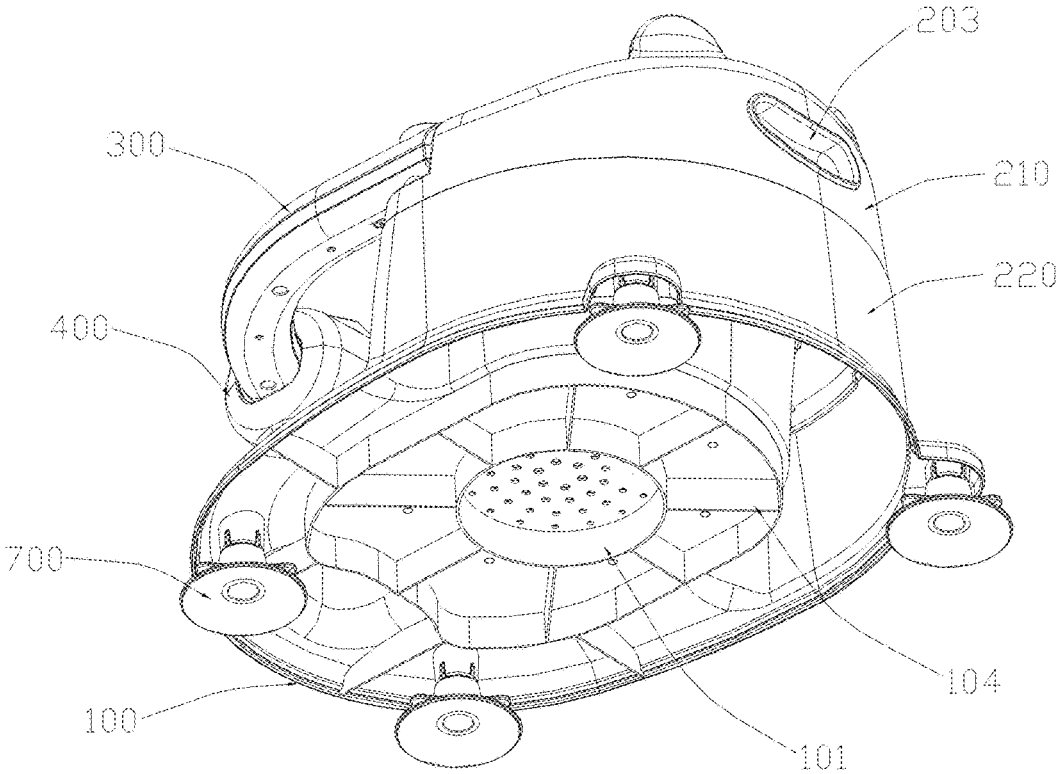
FIG. 2 is a schematic diagram of the baby bath chair showing another angle of the enclosed state according to the embodiment of the present disclosure.
Figure 3:
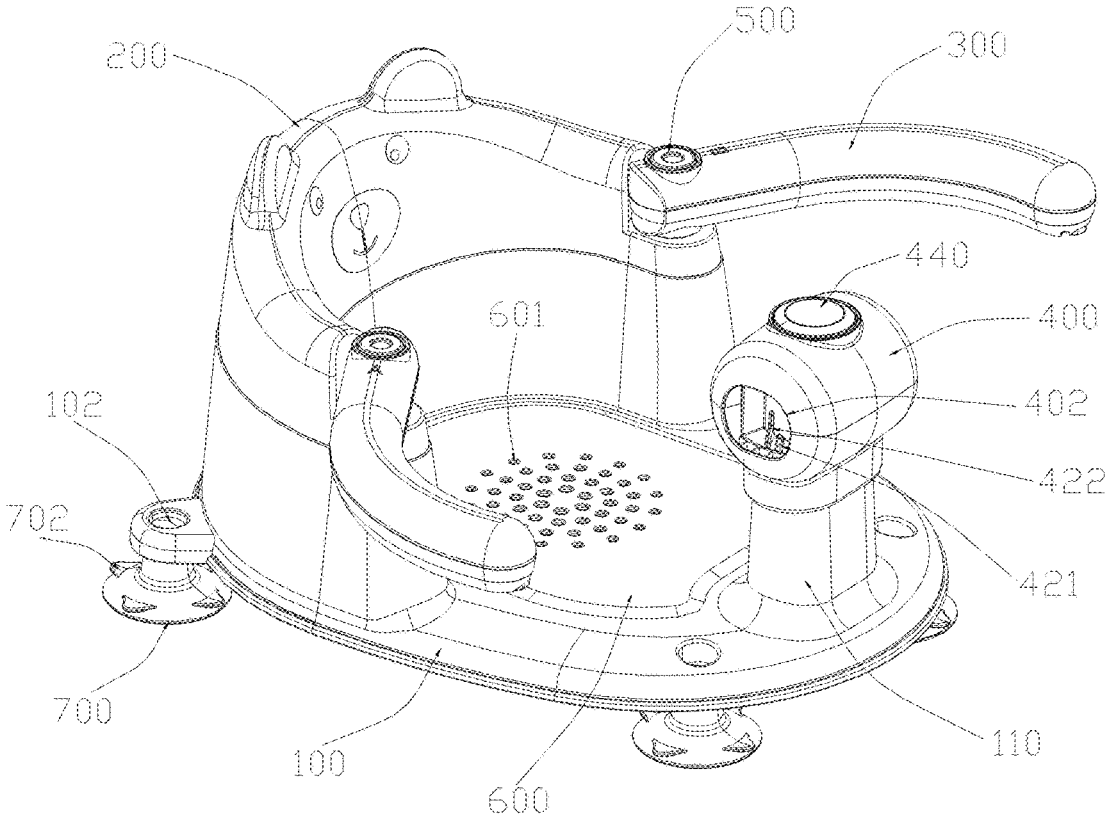
FIG. 3 is a schematic diagram of the baby bath chair showing a corner angle of an opened state according to the embodiment of the present disclosure.
Figure 4:
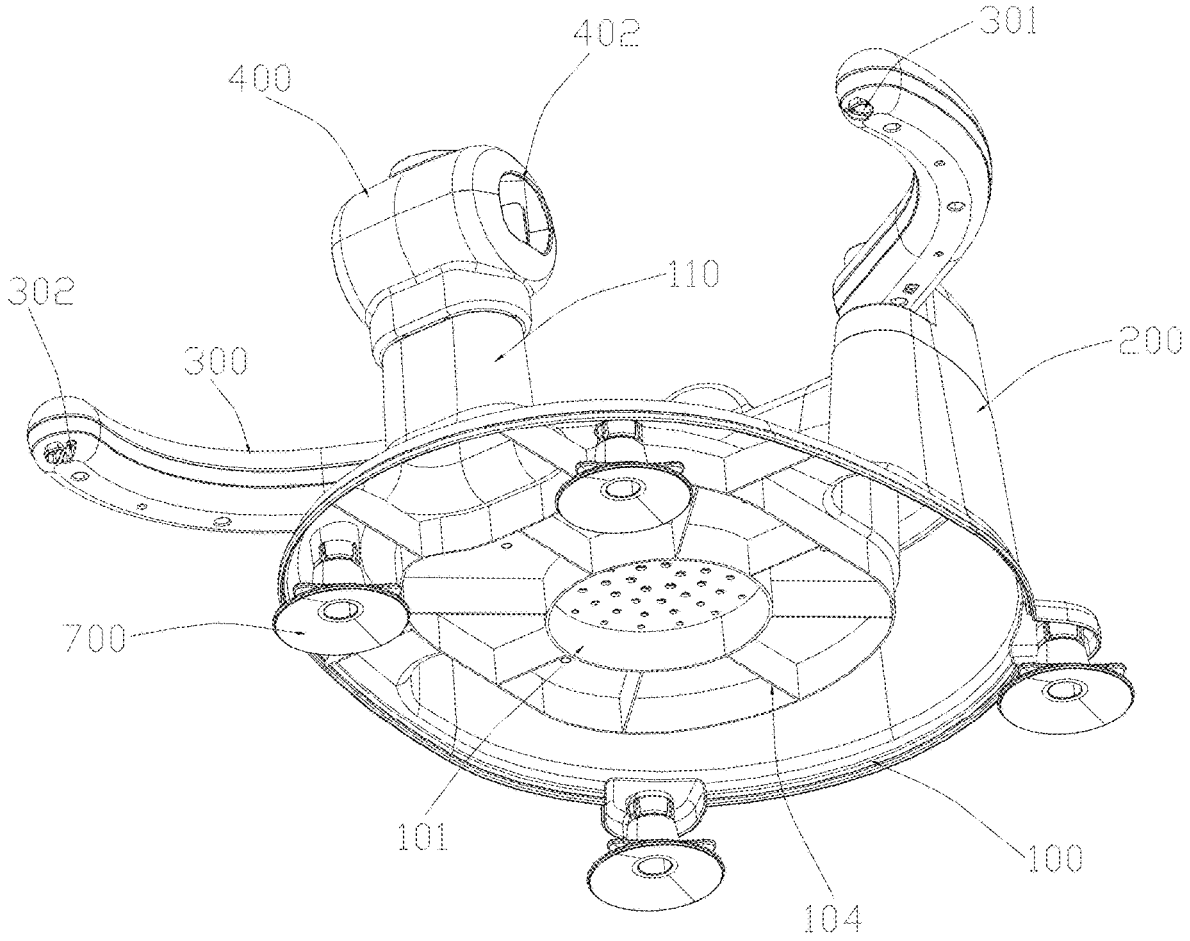
FIG. 4 is a schematic diagram of the baby bath chair showing another angle of the opened state according to the embodiment of the present disclosure.
Figure 5:
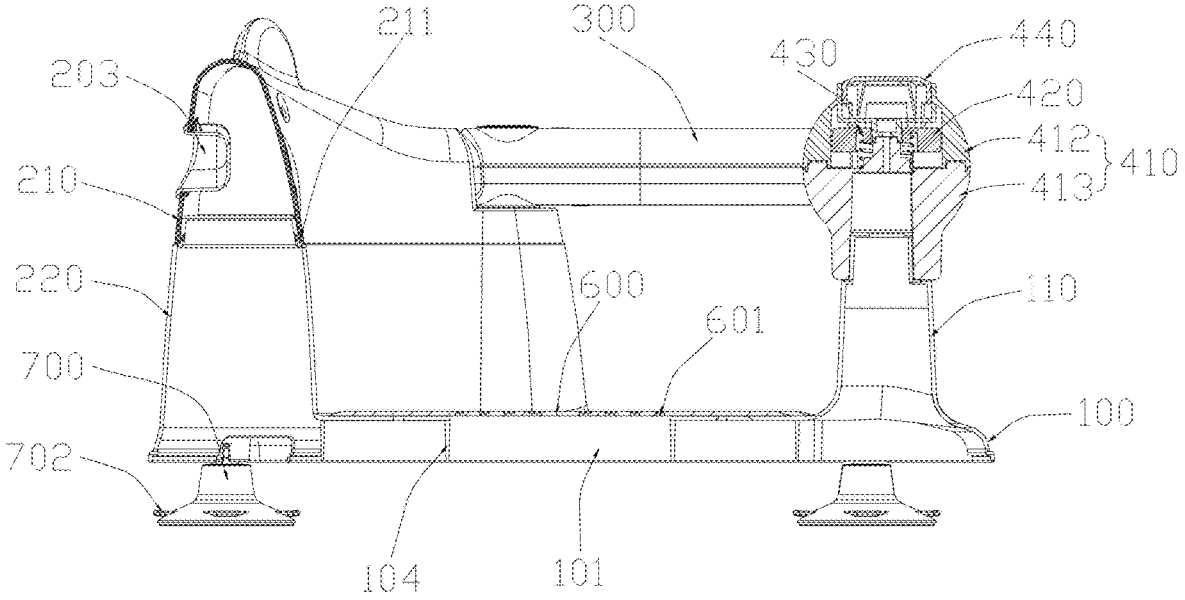
FIG. 5 is a schematic diagram of the baby bath chair showing a cross-sectional structure according to the embodiment of the present disclosure.
Figure 6:
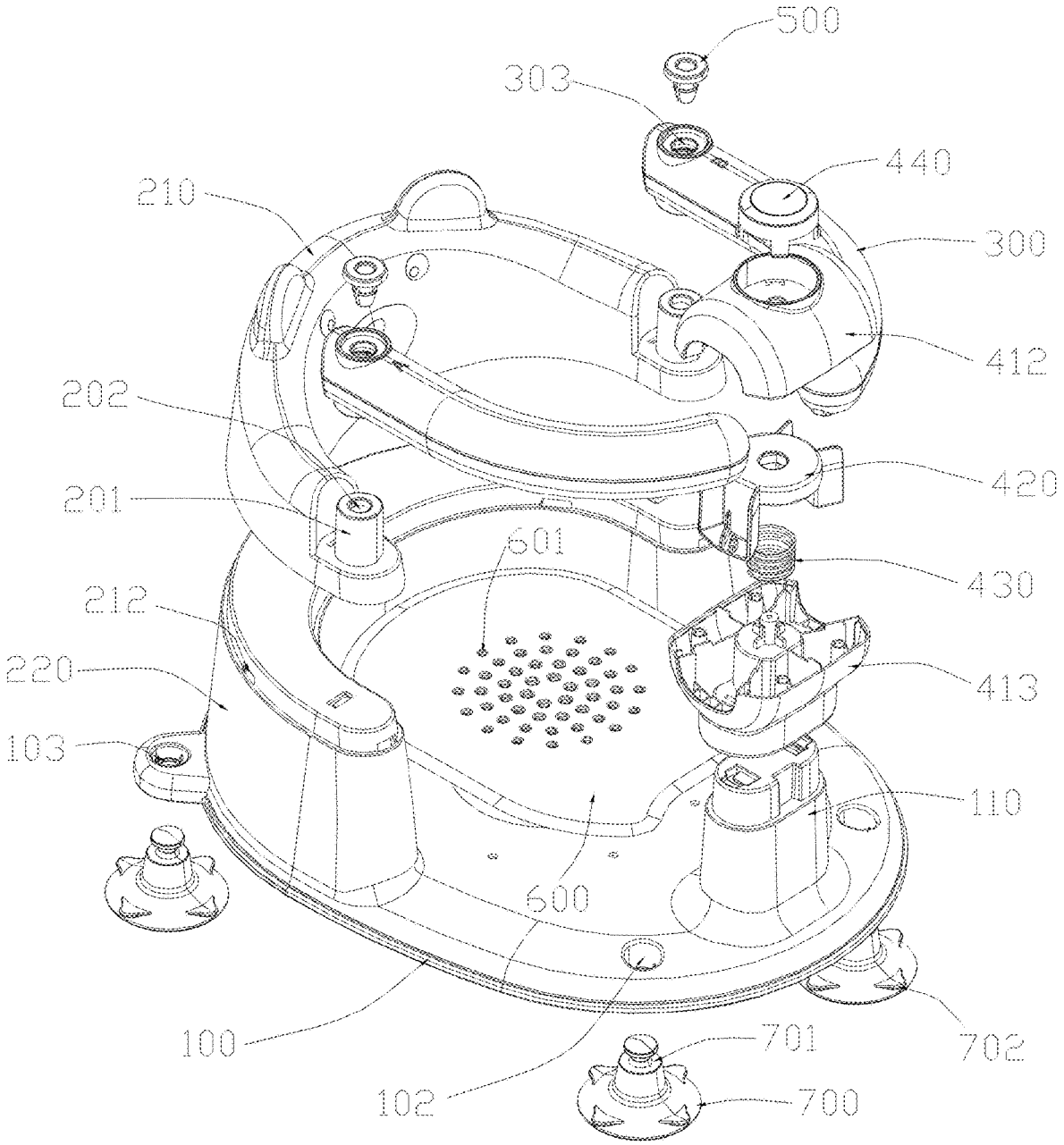
FIG. 6 is an exploded view of the baby bath chair showing one angle according to the embodiment of the present disclosure.
Figure 7:
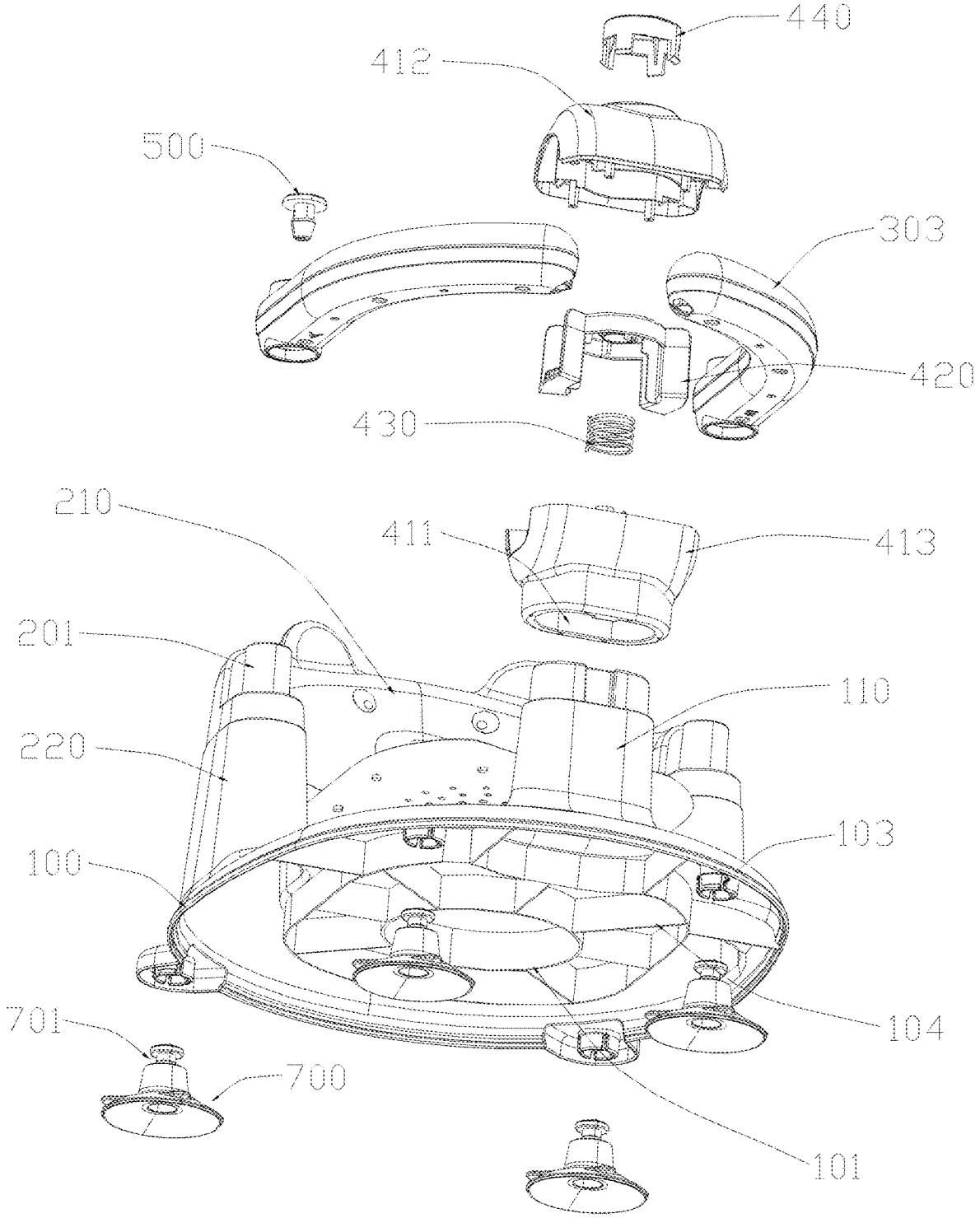
FIG. 7 is an exploded view of the baby bath chair showing another angle according to the embodiment of the present disclosure.

Refer to FIGS. 1-7, a baby bath chair includes a base 100 and a handrail 300. A rear side of the base 100 is provided with a backrest 200 extending upward. The handrail 300 is connected to the backrest 200 and is configured to rotate between the enclosed position and the opened position. When the handrail 300 rotates to the enclosed position, the handrail 300, the backrest 200 and the base 100 are enclosed to form a seat space to restrict a lateral movement of a baby's body.

Through above-mentioned structures, when the baby enters and exits the seat space of the bath chair, the handrail 300 rotates to the opened position, the baby can be convenient to enter and exit a seat space of the bath chair, and the operation is simple. And when bathing for the baby, the handrail 300 can rotates to the enclosed position, the handrail 300 and the backrest 200 can provide support at this moment, for restricting the baby's body circumferential lateral movement. The product use is safer, user is also more labor-saving in baby's bathing, the rotatable handrail 300 can be easily opened and closed for convenient use.

In this embodiment, a middle part of a front side of the base 100 is provided with a locking assembly 400, a connecting end of the handrail handrail 300 is hinged to the backrest 200, and a free end of the handrail 300 is detachably connected to the locking assembly 400. Through the above-mentioned structure, when bathing the baby, the locking assembly 400 can lock the free end of the handrail 300, enhance the stability of the product, prevent the baby from dumping, choking water which caused by the accidental opening of the handrail 300, effectively and stably restrict the baby's body, improve the safety of product use.

In this embodiment, the locking assembly 400 includes a locking housing 410, a locking block 420 and an elastic reset element 430. The locking block 420 can be slidably arranged in the locking housing 410 and moves between the locking position and the release position, one end of the clastic reset element 430 is butted against the locking block 420, the other end of the clastic reset element 430 is butted against the inner wall of the locking housing 410. And the clastic reset element 430 is configured to drive the locking block 420 to move towards the locking position to lock the free end of the handrail 300. Through the above-mentioned structure, when bathing the baby, the handrail 300 rotates to the enclosed position, and the elastic reset force of the clastic reset element 430 drives the locking block 420 to move towards the locking position, so that the locking block 420 is locked at the free end of the handrail 300, and the free end of the handrail 300 is stably connected with the locking assembly 400, and the stability of the product is improved. And when the handrail 300 needs to be detached and opened, the locking block 420 is moved to make the free end of the locking block 420 and the handrail 300 be detached, and the handrail 300 can freely rotate, and the operation is simple.

In this embodiment, the free end of the handrail 300 is provided with a locking groove 301, the locking block 420 is provided with a locking portion 421, and when the handrail 300 rotates to an enclosed position, the elastic reset element 430 drives the locking block 420 to move towards the locking position, and the locking portion 421 is inserted into the locking groove 301. Through the above-mentioned structure, the clastic reset element 430 drives the locking block 420 to move towards the locking position, so that the locking part 421 on the locking block 420 is inserted in the locking groove 301, the free end of the handrail 300 is firmly locked, the stability of the product is further improved, and the free end of the handrail 300 is prevented from being separated from the locking assembly 400.

In this embodiment, the free end of the handrail 300 is provided with a guide groove 302, the locking block 420 is provided with a guide portion 422, and when the handrail 300 rotates towards the enclosed position, the guide portion 422 is inserted along the guide groove 302 and slides in the guide groove 302. Through the above-mentioned structure, when the user rotates the handrail 300, the guide groove 302 is inserted and slides in the guide groove 302, the rotation direction of the handrail 300 can be guided, and then when the handrail 300 rotates to the enclosed position, the locking portion 421 is facing the locking groove 301, so that the locking portion 421 can be stably inserted into the locking groove 301 under the effect of the elastic reset element 430, and the stability of the product is improved.

In this embodiment, the locking assembly 400 further includes a pressing element 440, the pressing element 440 can be connected to the locking housing 410 in a sliding manner, a lower end of the pressing element 440 penetrates the locking housing 410 and is butted against the locking block 420, and the pressing element 440 is used for the user to press to drive the locking block 420 to move towards the release position, so as to release the free end of the handrail 300. Through the above-mentioned structure, pressing the pressing element 440 downwards can drive the locking block 420 to move downward, the elastic reset element 430 undergoes clastic deformation and stores the elastic potential energy at this moment, the locking portion 421 on the locking block 420 is detached from the locking groove 301, and the user can be allowed to rotate and open the handrail 300 to facilitate the user's operation. And when the user needs to lock the handrail 300, release the pressing element 440, the elastic reset element 430 resets, and drives the locking block 420 to move, so that the locking part 421 is inserted in the locking groove 301, and the free end of the handrail 300 is locked.

In this embodiment, the locking housing 410 includes an upper locking housing 412 and a lower locking housing 413, the upper locking housing 412 is connected to the lower locking housing 413, a cartridge groove 402 is formed between the upper locking housing 412 and the lower locking housing 413, and when the handrail 300 rotates to the enclosed position, the free end of the handrail 300 is inserted into the insertion groove 402. Through the above-mentioned structure, when in use, the upper locking housing 412 is connected to the lower locking housing 413, a cartridge groove 402 is formed between the upper locking housing 412 and the lower locking housing 413. And the free end of the handrail 300 is inserted in the cartridge 402. On one hand, it can play the role of fixing the free end of the handrail 300, on the other hand, the free end of the handrail 300 can also be hidden, the free end of the handrail 300 can prevent from scratching the baby. The product appearance is more beautiful, and the use is much safer.

In this embodiment, the middle part of the front side of the base 100 extends upward to form a connecting post 110, a bottom of the locking assembly 400 is provided with a connecting groove 411, and the connecting post 110 is inserted into the connecting groove 411. Through the above-mentioned structure, the middle part of the front side of the base 100 is provided with a connecting column 110, the connecting column 110 is inserted into the connecting groove 411 at the bottom of the locking assembly 400, the connection between the bottom of the locking assembly 400 and the base 100 can be realized, the assembly is more convenient, and the structure is more stable.

In this embodiment, the connecting end of the handrail 300 is provided with a shaft hole 303, a rotating shaft 201 is arranged on a side of the backrest 200, and the rotating shaft 201 is inserted into the shaft hole 303 so that the handrail 300 can rotate relative to the backrest 200. Through the above-mentioned structure, the rotating shaft 201 is matched with the shaft hole 303, and the rotatable connection of the handrail 300 and the backrest 200 can be realized, and the product connection is more stable, and the rotation is smoother.

In this embodiment, a shaft fixing element 500 is further included, a connecting hole 202 is arranged on a surface of the rotating shaft 201, a shaft fixing element 500 is inserted into the connecting hole 202 and an edge of the shaft fixing element 500 is butted against the connecting end surface of the handrail 300. Through the above-mentioned structure, when in use, the shaft fixer 500 is inserted along the connecting hole 202, and the edge of the shaft fixing element 500 is butted to the connecting end surface of the handrail 300 close to the shaft hole 303, so that the handrail 300 can be hindered from moving in the axial direction along the rotating shaft 201, so that the product structure is more stable.

In this embodiment, a cushion portion 600 is further provided, a surface of the cushion portion 600 is provided with a through hole 601, the middle part of the base 100 is provided with an opening 101, the cushion portion 600 is covered with an opening 101, and the through hole 601 is connected to the opening 101. Through the above-mentioned structure, the through hole 601 on the cushion part 600 communicates with the opening 101, water can be allowed to pass through the through hole 601 and the opening 101, facilitate the water to flow out, prevent water accumulation in the seat, and improve the user's use experience. Preferably, the cushion 600 is usually a soft material, which acts as a cushion and makes it more comfortable for the baby to sit in the seat.

In this embodiment, a suction cup 700 is further provided, the sucker cup 700 is connected to the bottom of the base 100, and the sucker cup 700 is used for adsorbing on a placement surface. Through the above-mentioned structure, the suction cup 700 can fix the base on the placement surface such as the bathroom floor, prevent the product from tipping, make the product more stable, and the user is safer to use.

In this embodiment, the base 100 is provided with a suction cup hole 102, and the suction cup 700 is detachably inserted into the suction cup hole 102. Through the above-mentioned structure, when the suction cup 700 is damaged, the user can disassemble and replace the suction cup 700 separately, without replacing the whole product, and the user saves costs.

In this embodiment, an upper part of the suction cup 700 is provided with a groove 701, an inner wall of the suction cup hole 102 is provided with a clamping portion 103, and the clamping portion 103 is clamped into the groove 701. Through the above-mentioned structure, the clamping portion 103 is clamped into the groove 701, the sucker 700 can be stably connected with the groove 701, the loading and unloading of the sucker 700 are convenient, and the structure is stable. Preferably, the inner wall of the suction cup hole 102 can also be provided with a deformation groove, allowing the deformation of the inner wall of the suction cup hole 102 when the suction cup 700 is inserted, and the user is further convenient to insert the suction cup into the suction cup hole 102.

In this embodiment, the backrest 200 includes an upper backrest housing 210 and a lower backrest housing 220, and the upper backrest housing 210 is detachably connected to the lower backrest housing 220. When in use, if the upper backrest housing 210 is damaged, the user can freely replace the upper backrest housing 210 to save costs. At the same time, the upper backrest housing 210 is generally provided with a decorative part, and the user can replace different upper backrest housing 210, realize the changes of product style, appearance, the product is more beautiful, and can also meet variety needs of users.

In this embodiment, the upper backrest housing 210 is provided with a clamping block 211, the lower backrest housing 220 is provided with a clamping groove 212, and the clamping block 211 is clamped into the clamping groove 212. Through above-mentioned structure, the clamping block 211 and the clamping slot 212 are more convenient for the user to disassemble and assemble the upper backrest housing 210, and the operation is simple, and the structure is stable.

In this embodiment, a surface of the backrest 200 is provided with a grasping groove 203, and the gripping groove 203 is used for the user's finger insertion. Through above-mentioned structure, when in use, the user can insert the finger into the gripping groove 203, so that the user is convenient to lift the product and makes the use more convenient.

In this embodiment, the bottom of the base 100 is provided with a reinforcing rib 104. Setting the reinforcing rib 104 can improve the strength of the product, improve the service life of the product, which makes the user experience better.

In this embodiment, the suction cup 700 is provided with a detachment bump 702, and the detached bump 702 is used for the user to grasp. When in use, the user can grasp the detachment bump 702 and lift it upward, and the suction cup 700 can be separated from the adsorption plane, so that the user can disassemble the product conveniently, and the use is more convenient.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A baby bath chair comprising:

a base (100), a rear side of the base (100) provided with a backrest (200) extending upward;

a handrail (300) connected to the backrest (200) and being able to rotate between an enclosed position and an opened position;

wherein the handrail (300) rotates to the enclosed position, the handrail (300), the backrest (200) and the base (100) enclose to form a seat space for restricting a movement of a baby's body, and a front central side of the base (100) is provided with a locking assembly (400), a connecting end of the handrail (300) is hinged to the backrest (200), and a free end of the handrail (300) is detachably connected to the locking assembly (400).

2. He baby bath chair according to claim 1, wherein the locking assembly (400) comprises a locking shell (410), a locking block (420) and an elastic reset element (430), the locking block (420) is configured to be slidingly arranged within the locking shell (410) and is configured to move between the locking position and the release position, one end of the elastic reset element (430) butts against the locking block (420), the other end of the elastic reset element (430) is pressed against the inner wall of the locking housing (410), the elastic reset element (430) is configured to drive the locking block (420) to move towards the locking position to lock the free end of the handrail (300).

3. The baby bath chair according to claim 2, wherein the free end of the handrail (300) is provided with a locking groove (301), and the locking block (420) provided with a locking part (421), when the handrail (300) rotates to the enclosed position, the elastic reset part (430) drives the locking block (420) to move toward the locking position, and the locking part (421) is inserted into the locking groove (301).

4. The baby bath chair according to claim 2, wherein the free end of the handrail (300) provided with a guide groove (302), the locking block (420) is provided with a guide portion (422), when the handrail (300) rotates towards the enclosed position, the guide portion (422) is inserted into and slides along the guide groove (302).

5. The baby bath chair according to claim 2, wherein the locking assembly (400) further comprises a pressing element (440), the pressing element (440) is slidely connected to the locking housing (410), a lower end of the pressing element (440) extends through the locking housing (410) to engage with the locking block (420), the pressing element (440) is configured to allow a user to press and moves the locking block (420) towards the release position for releasing the free end of the handrail (300).

6. The baby bath chair according to claim 2, wherein the locking housing (410) comprises an upper locking housing (412) and a lower locking housing (413), the upper locking housing (412) is connected to the lower locking housing (413), a cartridge groove (402) is formed between the upper locking housing (412) and the lower locking housing (413), when the handrail (300) rotates to the enclosed position, the free end of the handrail (300) is inserted into the cartridge groove (402).

7. The baby bath chair according to claim 1, wherein a front central side of the base (100) extends upward to form a connecting post (110), a bottom of the locking assembly (400) is provided with a connecting groove (411), and the connecting post (110) is inserted into the connecting groove (411).

8. The baby bath chair according to claim 1, wherein the baby bath chair further comprises a suction cup (700) connected to a bottom of the base (100), and the suction cup (700) is configured for adsorbing on a placement surface.

9. The baby bath chair according to claim 8, wherein the base (100) is provided with a suction cup hole (102), and the suction cup (700) is detachably inserted into the suction cup hole (102).

10. The baby bath chair according to claim 9, wherein the suction cup (700) is provided with an upper groove (701), and an inner wall of the suction cup hole (102) is provided with a locking part (103), and the ocking part (103) is clamped into the groove (701).

11. The baby bath chair according to claim 1, wherein the backrest (200) comprises an upper backrest shell (210) and a lower backrest shell (220), and the upper backrest shell (210) is detachably connected to the lower backrest housing (220).

12. The baby bath chair according to claim 11, wherein the upper backrest housing (210) is provided with a clamping block (211), the lower backrest housing (220) is provided with a clamping groove (212), and the clamping block (211) is clamped into the clamping groove (212).

13. The baby bath chair according to claim 1, wherein a surface of the backrest (200) is provided with a grasping groove (203), and the grasping groove (203) is configured for a user's fingers to insert.

14. The baby bath chair of claim 1, wherein a bottom of the base (100) is provided with a reinforcing rib (104).

15. The baby bath chair according to claim 8, wherein the suction cup (700) is provided with a detachment bump (702), and the detached bump (702) is configured for a user to grasp.

16. The baby bath chair according to claim 1, A baby bath chair comprising:

a base (100), a rear side of the base (100) provided with a backrest (200) extending upward;

a handrail (300) connected to the backrest (200) and being able to rotate between an enclosed position and an opened position;

wherein the handrail (300) rotates to the enclosed position, the handrail (300), the backrest (200) and the base (100) enclose to form a seat space for restricting a movement of a baby's body, and wherein the connecting end of the handrail (300) is provided with a shaft hole (303), a side of the backrest (200) is provided with a rotating shaft (201), and the rotating shaft (201) is inserted into the shaft hole (303) so that the handrail (300) is able to rotate relative to the backrest (200).

17. The baby bath chair according to claim 16, wherein the baby bath chair further comprises a shaft fixing element (500), a connecting hole (202) is arranged on a surface of the rotating shaft (201), the shaft fixing element (500) is inserted into the connecting hole (202), and an edge of the shaft fixing element (500) is butted against the connecting end surface of the handrail (300).

18. A baby bath chair comprising:

a base (100), a rear side of the base (100) provided with a backrest (200) extending upward;

a handrail (300) connected to the backrest (200) and being able to rotate between an enclosed position and an opened position;

wherein the handrail (300) rotates to the enclosed position, the handrail (300), the backrest (200) and the base (100) enclose to form a seat space for restricting a movement of a baby's body, and wherein the baby bath chair further comprises a cushion portion (600), a through hole (601) is provided on a surface of the cushion portion (600), an opening (101) is provided in a middle of the base (100), and the cushion portion (600) is adjacent to cover the opening (101), and the through hole (601) communicates with the opening (101).

* * * * *